United States Patent [19]

Dean

[11] 4,399,739

[45] Aug. 23, 1983

[54] NOISE ATTENUATING APPARATUS FOR MODULATING AIR FLOW

[75] Inventor: Raymond H. Dean, Johnson County, Kans.

[73] Assignee: Tempmaster Corporation, Kansas City, Mo.

[21] Appl. No.: 217,049

[22] Filed: Dec. 16, 1980

[51] Int. Cl.[3] ..... F24F 13/10

[52] U.S. Cl. ..... 98/41 R; 98/DIG. 10; 251/5; 251/61.1

[58] Field of Search ..... 98/40 C, 41 R, 41 AV, 98/DIG. 10; 251/5, 61.1

[56] References Cited

U.S. PATENT DOCUMENTS

| | | | |
|---|---|---|---|
| 2,829,581 | 4/1958 | Rumer, Jr. | 98/2.09 |
| 3,434,409 | 3/1969 | Fragnito | 98/41 R |
| 3,556,465 | 1/1971 | Little | 251/61.1 |
| 3,574,310 | 4/1971 | Souriau | 251/61.1 X |
| 3,796,367 | 3/1974 | Rifkin | 236/49 |
| 3,967,780 | 7/1976 | Traver | 236/49 |
| 4,014,381 | 3/1977 | Clark | 165/2 |
| 4,077,310 | 3/1978 | McCabe, Jr. et al. | 98/40 D |
| 4,077,567 | 3/1978 | Ginn et al. | 236/49 |

FOREIGN PATENT DOCUMENTS

| | | | |
|---|---|---|---|
| 1913355 | 10/1969 | Fed. Rep. of Germany | 251/61.1 |
| 2395441 | 1/1979 | France | 251/61.1 |

*Primary Examiner*—Albert J. Makay
*Assistant Examiner*—Harold Joyce
*Attorney, Agent, or Firm*—Kokjer, Kircher, Bradley, Wharton, Bowman & Johnson

[57] ABSTRACT

A distribution duct for conditioned air has elongate outlet slots which are opened and closed by a sound absorbing foam pad controlled by inflatable air bladders. The duct walls adjacent the slots are generally parallel to the face of the pad to create thin air flow channels which effect attenuation of noise when the pad is fully or partially open. When the bladders are fully inflated, they press the pad into the slots and into tight sealing contact with the slot edges.

12 Claims, 7 Drawing Figures

NOISE ATTENUATING APPARATUS FOR MODULATING AIR FLOW

BACKGROUND OF THE INVENTION

Heating and cooling systems for relatively large buildings such as office buildings normally include ventilation ducts which direct conditioned air to the separate rooms of the building. Individual temperature control for the separate offices or other sections of the building is achieved by controlling the volume of air flow through the duct or through the air outlet which discharges the conditioned air into the room. Typically, a damper or other flow control device is adjusted to regulate the flow of conditioned air to an air diffuser or similar outlet device, thereby controlling the room temperature. Air distribution systems of this type are generally high in efficiency and low in cost since they utilize a single large heating or cooling unit to supply several rooms or floors. At the same time, there is no sacrifice in the individual temperature control for each office. Nonetheless, this type of air distribution system has not been wholly without problems. It has proven difficult to achieve accurate and repeatable control of the flow control device, and the temperature control of the individual rooms has suffered accordingly. Equally significant, the air which passes from the ductwork through the air diffuser generates considerable noise which can at times be highly objectionable. When the outlet opening of the duct is nearly closed, the acoustical problems are greatest since in that situation the air flow tends to create noise producing eddies or vortices adjacent the edges of the outlet opening. Discharge openings having flanges or other configurations which present sharp edges tend to aggravate the problem because the sharp edges are particularly prone to creation of vortices which remain undamped. Additional noise can result from vibration or pulsation of the control device or the duct walls surrounding the discharge opening.

SUMMARY OF THE INVENTION

The present invention is aimed at eliminating these problems and has, as its primary object, the provision of a device which accurately controls the air flow through a duct outlet while at the same time reducing objectionable noise. In accordance with the invention, the duct outlets are in the form of elongate slots which are opened and closed by a foam pad under the control of an inflatable air bag or bladder. The pad is porous and functions as a sound absorbing medium, while its position relative to the outlet slot is controlled by the inflatable air bladder.

In the open position, the bladders are deflated and air can flow freely through the slots and against the foam pads which serve to attenuate the noise without appreciably interferring with the air flow. In the typically noisy state where the outlet is almost completely closed, the acoustical performance of the device is significantly improved as compared to existing arrangements, due primarily to the configuration of the outlet slots and the adjacent duct walls. The close proximity and parallel relationship of the foam pad to the duct walls effects damping of any vortices since the air is forced to pass at least partially through the pad. In the fully closed position, the air bladders are inflated and the pad is squeezed tightly against the edges of the slot to reduce the porosity of the pad in the high pressure area adjacent the slots. A tight seal is thus formed, and there is very little leakage of air. In an alternative form of the invention, the pad is constructed of non-porous foam and in the closed position is squeezed against foam strips that extend along the slot edges.

The combination of a porous pad for absorbing sound and an elongate outlet slot with adjacent duct wall surfaces parallel to the pad results in a low noise level, low operating pressure requirements, effective flow control and resistance to clogging. The use of elongate slots, as opposed to a series of relatively small holes, permits the pad to "bulge up" well into the slots and thus provide sufficient surface tension at the slot edges to squeeze the foam in a manner to effictively seal the slot while reducing the porosity of the pad at the high pressure region.

DETAILED DESCRIPTION OF THE INVENTION

In the accompanying drawings which form a part of the specification and are to be read in conjunction therewith and in which like reference numerals are used to indicate like parts in the various views.

Figure 2:
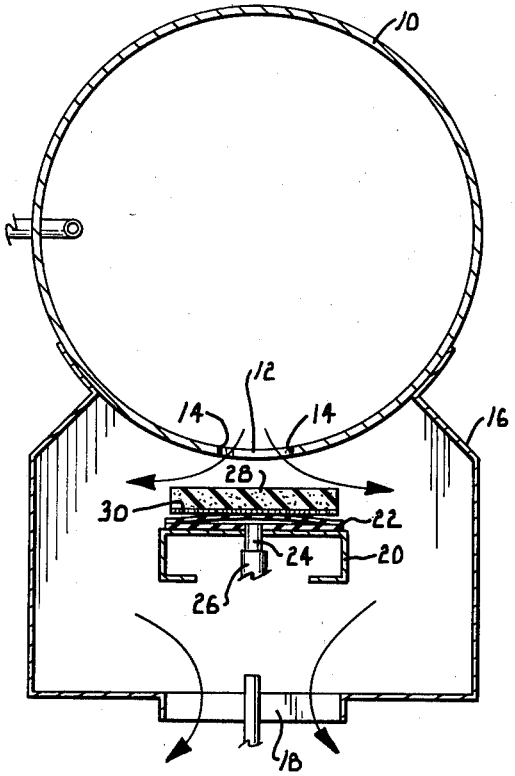
FIG. 2 is a sectional view on an enlarged scale taken on a vertical plane transversely of the ventilation duct and illustrating the fully open position of the outlet slot of the duct.
Figure 3:
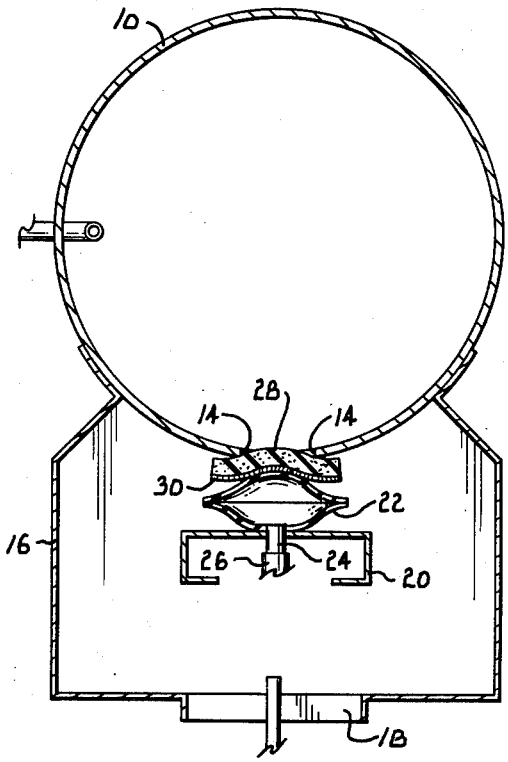
FIG. 3 is a sectional view similar to FIG. 2 but showing the outlet slot in the fully closed position.

Referring now to the drawing in detail, numeral 10 designates a cylindrical ventilating duct forming part of the duct work of an air distribution system. The duct work receives conditioned air from a heating or cooling unit (not shown) and delivers the conditioned air to the various rooms of the building containing the air distribution system. Duct 10 has a pair of elongate slots 12 formed in its lower portion for discharging the conditioned air. As shown in FIGS. 2 and 3, each slot 12 has a pair of spaced apart side edges 14 extending the length of the slot. Slots 12 are axially aligned and preferably have rounded ends.

An air diffuser 16 is secured to duct 10 at a location to receive the conditioned air discharging from the duct through the outlet slots 12. Air diffuser 16 has a hollow interior region and presents on its bottom wall an outlet slot 18 which connects with a diffuser structure (not shown) to deliver the conditioned air into an office or other room of the building.

A metal pan 20 is mounted substantially centrally within air diffuser 16 at a location spaced directly below the outlet slots 12 of the duct. The pan 20 has its opposite ends connected with end walls of diffuser 16. Supported on the upper surface of pan 20 are a pair of pliable air bags or bladders 22 which are identical to one another. The bladders 22 are located below the respective outlet slots 12 of the duct. The air bladders 22 have fittings 24 which extend downwardly into the interior of pan 20 for receiving air to inflate the bladders from the fully deflated position shown in FIG. 2 to the fully inflated position shown in FIG. 3. Each fitting 24 connects with a conduit 26 which communicates at its opposite end with a source of air under pressure. Control of the inflation and deflation of bladders 22 can be carried out in any suitable manner, such as under the control of a thermostat (not shown).

A porous foam pad 28 is located on top of air bladders 22 at a location immediately below slots 12. Pad 28 is constructed of a soft foam substance which is capable of acting as a sound absorbing medium in order to absorb the sound from the air discharging through slots 12. Pad 28 permits air to flow through it in limited quantities when the pad is in its normal undeformed condition (FIG. 2). The length of pad 28 is at least as great as the combined lengths of slots 12. The flat top surface of pad 28 is substantially parallel to the outside surface of duct 10 in the areas surrounding slots 12. The four corners of the pad may be connected with duct 10 if desired.

The underside of pad 12 may be provided with a plurality of felt strips 30 which stiffen the pad without detracting from its acoustical properties. In a typical arrangement, strips 30 are adhesively attached to the bottom surface of pad 28 and are approximately one inch wide and spaced four inches apart from one another. In actual practice, the strips 30 are rarely needed and may usually be eliminated.

In operation, slots 12 are fully open to effect maximum flow of conditioned air when bladders 22 are completely deflated, as shown in FIG. 2. Conditioned air can then flow freely out of duct 10 though slots 12 and against the top surface of pad 28. The pad diverts the flow to both sides, as indicated by the directional arrows in FIG. 2, and acts as a sound absorbing medium to attenuate the noise produced by the flowing air. The pad presents only minimal resistance to the air flow. After passing into the air diffuser 16, the conditioned air flows into the room through slot 18.

When bladders 22 are partially inflated, they effect lifting of pad 28 toward slots 12 and thus decrease the volume of air which can pass through the slots with increasing inflation of the bladders. When the bladders are inflated to the point where pad 28 initially touches or nearly touches duct 10 adjacent the slot sides 14, only a small volume of air can pass though the slots. In this condition, objectionable noise is most likely since the edges 14 are capable of shedding eddies or vortices which produce noise. However, in the present invention, since the porous pad 28 is either touching or is very close to touching the outside duct surfaces surrounding slots 12, the vortices are immediately dissipated by the pad. In addition to damping the vortices, pad 28 is sufficiently porous to permit a substantial flow of air through it at moderate pressure differential. Consequently, the sound attenuating characteristics of the apparatus are outstanding in this typically noisy air flow state. The small space presented between the duct walls and the upper surface of pad 28 causes the air to flow in much the same manner as flow through a long, thin-lined duct. The overall result is that the air quantity modulates smoothly with increasing inflation of bladders 22, due to the long, thin-lined duct effect and passage of the air partially through the porous pad.

When bladders 22 are fully inflated as shown in FIG. 3, pad 28 is caused to bulge up well into slots 12, and the force applied by the inflated bladders squeezes or stretches the pad tightly against the relatively small surface area around edges 14 of the slots. Such squeezing of the pad reduces its thickness and decreases its porosity in the high pressure region adjacent the slot, and a tight seal of the pad against the slot edges is achieved. Very little air is able to pass through the low porosity region of the pad and there is thus very little air leakage in the closed position.

In addition to effecting smooth air flow, the cylindrical shape of duct 10 assists in eliminating the possibility of pulsation or vibration. The curved duct walls adjacent slots 12 are stiffer and stronger than flat wall surfaces and are less susceptible to fluctuation than flat walls. Thus, vibration at the edges of the slots, pad and bladders is substantially eliminated.

It is important to note that the outside surfaces of duct 10 adjacent slots 12 are substantially parallel to the upper surface of pad 28. This results in the formation of relatively long, thin flow channels in the space presented between the sheet metal duct and the foam pad. Such long, thin channels result in vortices being quickly dissipated and is highly important to the acoustical performance of the apparatus. An arrangement having flanges or the like extending downwardly from the slot edges 14 is less satisfactory because the flanges present walls adjacent the air slot which are substantially perpendicular to the pad surface. As a consequence, the vortices which are shed by the sharp edges of the flanges have considerable space between the duct walls and the pad, and the vortices thus tend to remain undamped and create objectionable noise. It is also important to note that the porous pad provides effective dissipation of the vortices and is highly effective in attenuating the residual noise generated. Impervious pads do not function as well from an accoustical standpoint.

The use of elongate slots 12 is preferred over a series of small holes or other outlet configurations. The long slots permit the bag to bulge up well into them, with the bulging producing enough surface tension at the slot edges to squeeze the foam against the edges in a manner to provide an effective seal at the fully closed position. The squeezed pad portions are reduced substantially in their porosity and thus resist leakage of air when the pad is fully closed against the slots.

Figure 4:
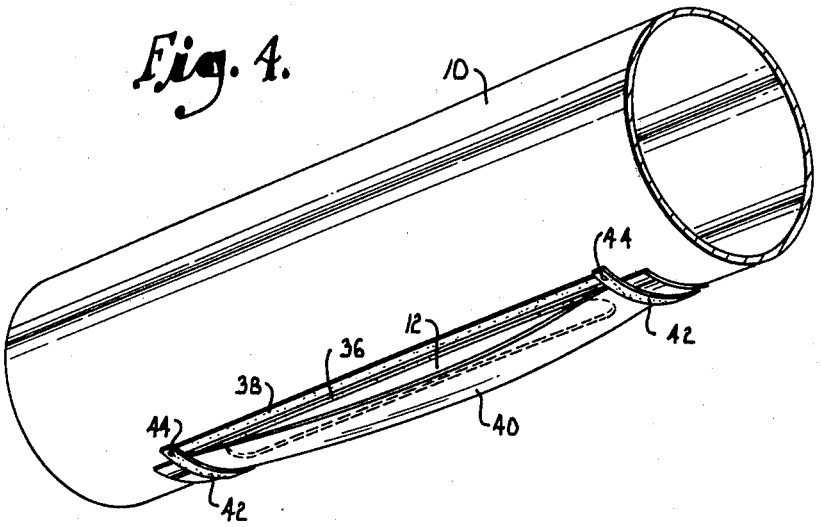
FIG. 4 is a perspective view of a duct section which is equipped with a neoprene sheet and foam strips in accordance with a modified form of the invention.

FIG. 4 illustrates a modified arrangement wherein foam strips 36 are secured to the outer surface of duct 10 in an extension along the opposite side edges 14 of each slot 12. Felt strips 38 are secured to the duct at locations adjacent and parallel to the foam strips 36. A neoprene sheet 40 substantially covers slot 12 but presents gaps along each side edge of the slot to permit air to flow out the sides of the slots in the open position thereof. A pair of straps 42 are attached to duct 10 by screws 44 to hold the sheet 40 in position on the duct. Sheet 40 covers the ends of slot 12 to prevent passage of air out side ends.

Figure 5:
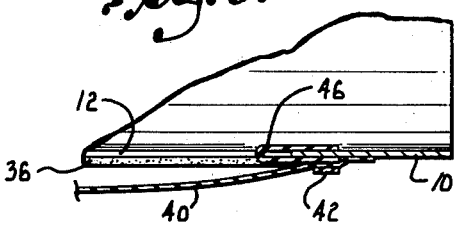
FIG. 5 is a fragmentary perspective view on an enlarged scale showing the details of the slot ends in the arrangement of FIG. 4.

FIG. 5 shows an adhesive gasket strip 46 which surrounds the downstream end of each slot 12. The gasket strip 46 is provided with adhesive or the like in order to permit attachment to the duct and to sheet 40. Strip 46 cover the downstream end of the slot in order to prevent air flow between the duct wall and the neoprene sheet and to attenuate noise.

Figure 6:
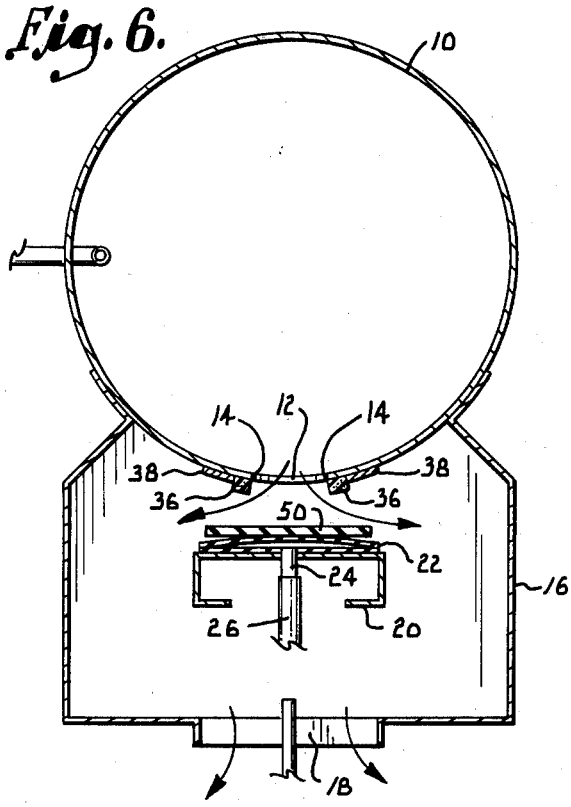
FIG. 6 is a sectional view taken on a vertical plane transversely of a ventilating duct and illustrating an alternative embodiment of the invention with the outlet slot fully open.
Figure 7:
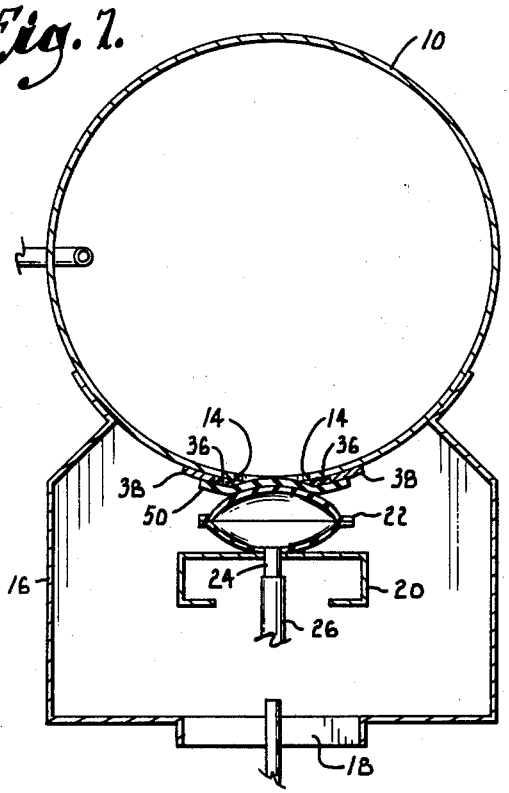
FIG. 7 is a sectional view similar to FIG. 6 but showing the outlet slot in the fully closed position.

Referring now to FIGS. 6 and 7, the porous foam strips 36 and felt strips 38 are located above the metal pan 20 and the air bag 22 which have been described in connection with FIGS. 1–3. In the arrangement of FIGS. 6 and 7, a non-porous foam pad 50 is positioned on and controlled by the air bladder 22, in place of the porous foam pad 28 shown in FIGS. 1–3.

Figure 1:
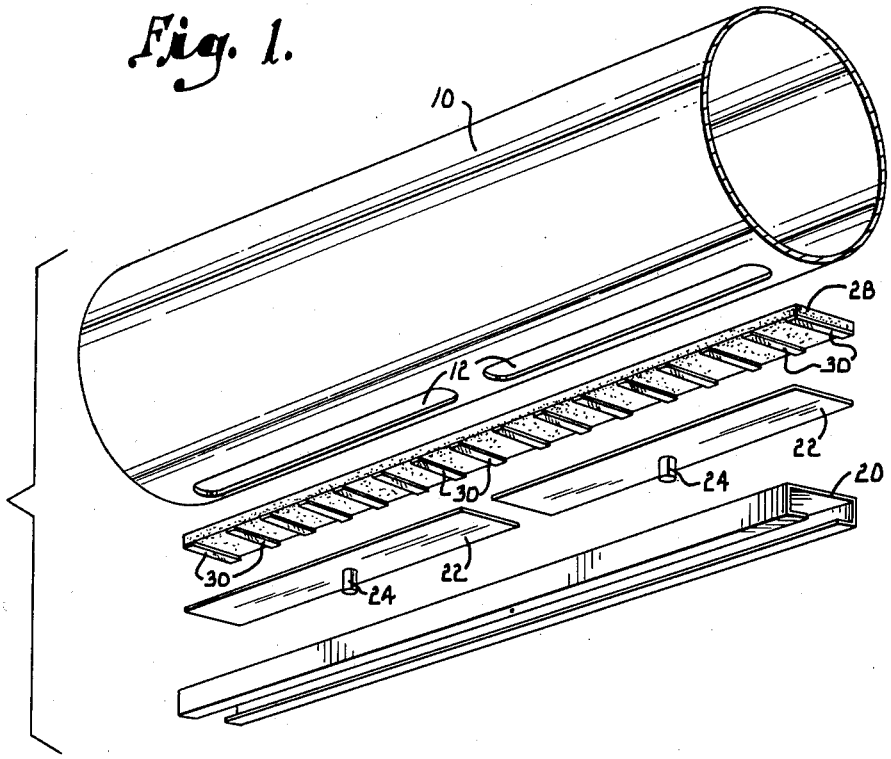
FIG. 1 is an exploded perspective view illustrating the components of an air flow modulating apparatus constructed according to a preferred embodiment of the present invention.

The embodiment of the invention shown in FIGS. 6 and 7 operates in much the same manner as the embodiment of FIGS. 1–3. When air bladder 22 is fully deflated, slot 12 is fully open and conditioned air can flow relatively freely through the slot and air diffuser into the room. As the air bladder inflates, the impervious pad 50 approaches the porous foam strips 36 at the side edges of the slots. When the non-porous pad 50 initially contacts strips 36, the conditioned air is forced to pass though the porous foam strips, and vortices are thus prevented. At full inflation of the bladder, the foam strips 36 are crushed as shown in FIG. 7, and pad 50 then seats firmly against the substantially impervious felt strips 38. The provisions of porous foam strips along the side edges of the outlet slot prevents the formation of eddies and vortices to attenuate noise, while the non-porous pad 50 and felt strips 38 effect a tight seal in the fully inflated condition of the bladder.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since may possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Noise attenuating apparatus for modulating conditioned air flow in an air distribution system, said apparatus comprising:

a duct adapted to receive the conditioned air, said duct presenting at least one outlet for discharge of the conditioned air;

a sound absorbing pad constructed of a deformable substance which is porous to the conditioned air and supported adjacent said outlet for controlling air flow therethrough, said pad having an undeformed condition wherein air flow through the outlet is permitted with the pad displaced from said outlet directly in the path of the air passing through said outlet to attenuate the noise associated with the air flow; and an inflatable air bladder adjacent said pad for controlling the position of same, said bladder having a deflated condition wherein the pad is in the undeformed condition thereof to permit air flow through the outlet while attenuating the noise, and an inflated condition wherein said bladder deforms the pad against said outlet in a manner to substantially block air flow through the outlet, whereby inflation and deflation of said bladder effects control of the flow of air through said outlet.

2. Apparatus as set forth in claim 1, wherein said outlet comprises an elongate slot having spaced apart side edges, said bladder passing said pad partially into said slot into sealing contact with said side edges in the inflated condition of the bladder.

3. Apparatus as set forth in claim 2, wherein said duct presents an outside surface adjacent said side edges of the slot, said outside surface being substantially parallel to a surface of said pad which faces the slot.

4. Apparatus as set forth in claim 2, wherein inflation of said bladder effects squeezing of the portions of said pad which contact said side edges of the slot, said squeezed portions of the pad being reduced in porosity to effect sealing of the slot in the inflated condition of the bladder.

5. Apparatus as set forth in claim 2, wherein said duct is substantially cylindrical and presents an outside surface adjacent said side edges of the slot, said outside surface being generally parallel to a surface of the pad which faces the slot.

6. Apparatus as set forth in claim 1, wherein said pad is formed from a porous foam substance through which air can pass in a limited quantity in the undeformed condition of the pad.

7. Apparatus as set forth in claim 6, wherein said outlet comprises an elongate slot having side edges against which said pad seals in the inflated condition of the bladder.

8. Apparatus as set forth in claim 7, including an outside surface of said cut adjacent said side edges of the slot, said outside surface being substantially parallel to a surface of the pad which faces the slot.

9. Apparatus as set forth in claim 1, including a plurality of stiffeners on said pad between the pad and bladder for stiffening the pad.

10. Noise attenuating apparatus for modulating conditioned air flow, said apparatus comprising:

a duct adapted to receive the conditioned air, said duct presenting an elongate outlet slot having spaced apart side edges and an outside surface of the duct located adjacent said side edges;

a porous pad underlying said slot and presenting a sound absorbing medium for absorbing sound from the air encountering the pad, said pad being porous to the conditioned air and having an upper surface oriented generally parallel to said outside surface of the duct; and an inflatable bladder located adjacent a lower surface of said pad, said bladder having a deflated condition wherein the pad is spaced below said slot in the path of air discharging therefrom and an inflated condition wherein the bladder effects squeezing of selected portions of the pad against side edges of said slot to seal the slot against air flow with the squeezing of said selected portions of the pad decreasing the porosity of said selected portions.

11. Noise attenuating apparatus for modulating conditioned air flow, said apparatus comprising:

a duct adapted to receive the conditioned air, said duct presenting an elongate outlet slot having spaced apart side edges and an outside surface of the duct located adjacent said side edges;

a pair of porous strips on said outside surface of the duct adjacent to and extending along said side edges of the slot, said strips being porous to the conditioned air;

an impervious pad underlying said slot; and an inflatable bladder underlying said pad for controlling the position of same relative to said slot, said bladder having a deflated condition wherein the pad is spaced below the slot and displaced from said porous strips to permit passage of conditioned air through the slot, and an inflated condition wherein said pad is forced against said strips to squeeze the same in a manner to fully close the slot to air flow, said strips permitting air flow therethrough when contacted by the pad with insufficient force to squeeze the strips enough to effect full closing of the slot.

12. Apparatus as set forth in claim 11, including a pair of substantially impervious strips on said outside surface of the duct extending generally along and adjacent to said porous strips at locations to seal against said pad in the inflated condition of said bladder.

* * * * *